United States Patent [19]

Kenyon

[11] 4,289,242

[45] Sep. 15, 1981

[54] DISPLAY SECURITY DEVICE

[76] Inventor: David L. Kenyon, 1727 W. Royalton Rd., Broadview Hts., Ohio 44147

[21] Appl. No.: 71,777

[22] Filed: Aug. 31, 1979

[51] Int. Cl.[3] ..... A47F 5/00

[52] U.S. Cl. ..... 211/4; 211/59.1

[58] Field of Search ..... 211/4, 7, 57.1, 59.1, 211/54.1; 70/57

[56] References Cited

U.S. PATENT DOCUMENTS

| | | | |
|---|---|---|---|
| 1,856,239 | 5/1932 | Buckley | 211/4 |
| 3,084,802 | 4/1963 | Ittner | 211/4 |
| 3,934,727 | 1/1976 | Brefka | 211/7 |
| 4,155,458 | 5/1979 | Moline | 211/4 |

*Primary Examiner*—Ramon S. Britts
*Assistant Examiner*—Robert W. Gibson, Jr.
*Attorney, Agent, or Firm*—Pearne, Gordon, Sessions, McCoy & Granger

[57] ABSTRACT

A security device is disclosed for use with a hanger extending from the board. The device comprises two split bar units mounted on the hanger. One bar unit is mounted near the end of the hanger adjacent to the board, and the other bar unit is mounted on the hanger near the opposite end thereof. Each split bar unit comprises two bar portions secured together by releasable fastening means. A removable rod is inserted through a passage in each bar unit and extends between the bar units. The rod prevents release of the fastening means. Lock means are provided for preventing removal of the rod from the passages in the bar units. The security device provides an inexpensive, but very secure, means of preventing theft or pilferage of merchandise displayed for sale on conventional hangers mounted on perforated boards.

11 Claims, 5 Drawing Figures

DISPLAY SECURITY DEVICE

FIELD OF THE INVENTION

This invention relates to devices for attachment to display elements, such as hangers for perforated boards or pegboards, which prevent removal of items from the elements and removal of the elements from their boards.

DESCRIPTION OF THE PRIOR ART

In the sale of various kinds of merchandise from self-serve outlets or from department stores, the merchandise is often displayed on supporting elements which are attached to or mounted on vertically extending display boards. A common method of displaying such merchandise is by using supporting hangers or rods which are mounted on and extend from boards having spaced perforations or holes, which boards are commonly known as "pegboards." In many instances, the relatively valuable merchandise may be displayed in this manner. For example, tennis rackets may be displayed in a store on a pair of hangers or rods attached to a perforated board, and display cards carrying cassette tapes may be displayed for sale in this manner.

In the display of relatively valuable items of merchandise for sale, particularly in outlets in which the displays remain relatively unsupervised, such as in self-serve outlets, it is important to maintain a certain amount of security over the merchandise so that it may not be removed from the hanger except with the assistance of floor personnel. In this manner, the unauthorized pilferage or theft of merchandise may be avoided.

Usually, a plurality of items of merchandise are displayed on a single set of hangers so that individual locking of the merchandise items to the hanger is impractical. It has been contemplated in the past to provide the hangers with a security device to prevent removal of the merchandise items off the end of the hangers, but such a device permits theft of the merchandise by simply removing the hanger from the perforated board.

Various devices have been developed to assure that the hanger cannot be removed from the perforated board. Such devices are shown in U.S. Pat. No. 3,785,501, issued to Canning. However, this device requires a specially constructed hanger and a large amount of associated hardware adjacent to the hanger, which results in the device being complicated, expensive, and prone to malfunction. Another theft-proof device for use in conjunction with a hanger for a perforated board is shown in U.S. Pat. No. 3,622,011, issued to Snow. This device also requires a specialized hanger, and thus it is not possible to use this device with various different kinds and sizes of merchandise unless a full array of specialized hangers are obtained. U.S. Pat. No. 3,934,727, issued to Brefka, discloses the use of a special hinged cover over the hanger and a plaque covering the board. However, this device is limited in use to items such as cords of a certain size which can be mounted on a single hanger, and it is not adaptable for use with larger merchandise or a plurality of hangers.

The security device disclosed in U.S. Pat. No. 4,026,415, issued to Sarley, discloses a display assembly having a plurality of pins which are permanently attached to a board and having an outer transparent cover which protects the items and prevents unauthorized removal of the items. This device requires a complete specialized assembly, and it is not adaptable for use with the common perforated display board or pegboard.

While devices of the prior art generally provide security for the display of merchandise, they often require a large amount of specially designed elements and specialized apparatus which may be complicated to use, expensive to obtain, and subject to malfunction. In addition, many of the prior art devices are incapable of use with different sizes and types of merchandise or with more than one hanger.

SUMMARY OF THE INVENTION

The present invention overcomes the shortcomings and limitations of the prior art devices by providing a security device for use in association with a hanger assembly extending from display boards which comprises relatively few members which are simple and relatively inexpensive to manufacture, and thus provides a security device which is easy to use, not prone to malfunction, and which can be manufactured and purchased at a relatively low price. In addition, the device of the present invention is made of relatively heavy and tamperproof elements which make it extremely difficult to break or otherwise circumvent, and thus provides a very secure device for preventing theft of merchandise. The device of the present invention is also adaptable for use with two or more hangers, so that relatively large or unusually shaped items which must be supported on a number of hangers can be protected by this device. The present invention also includes an element which may be used to prevent removal of the hanger assembly from the board, and thus overcomes the shortcomings of prior art devices which prevented the removal of merchandise from the hangers but which may not have prevented removal of the entire hanger assembly from the board.

These and other advantages are provided by the present invention of a security device for use with a hanger extending from the board. The security device comprises two split bar units mounted on the hanger. One bar unit is mounted near the end of the hanger adjacent to the board, and the other bar unit is mounted on the hanger near the opposite end of the hanger. Each split bar unit comprises two bar portions secured together by releasable fastening means, and each bar unit has a passage extending through a portion of the bar unit. A removable rod is inserted through the passage in each bar unit and extends between the bar units. The rod prevents release of the fastening means. Lock means are provided for preventing the removal of the rod from the openings in the bar units. Preferably, the rod is capable of extending to the board to prevent disengagement of the hanger with the board.

DESCRIPTION OF THE PREFERRED EMBODIMENTS

Figure 1:
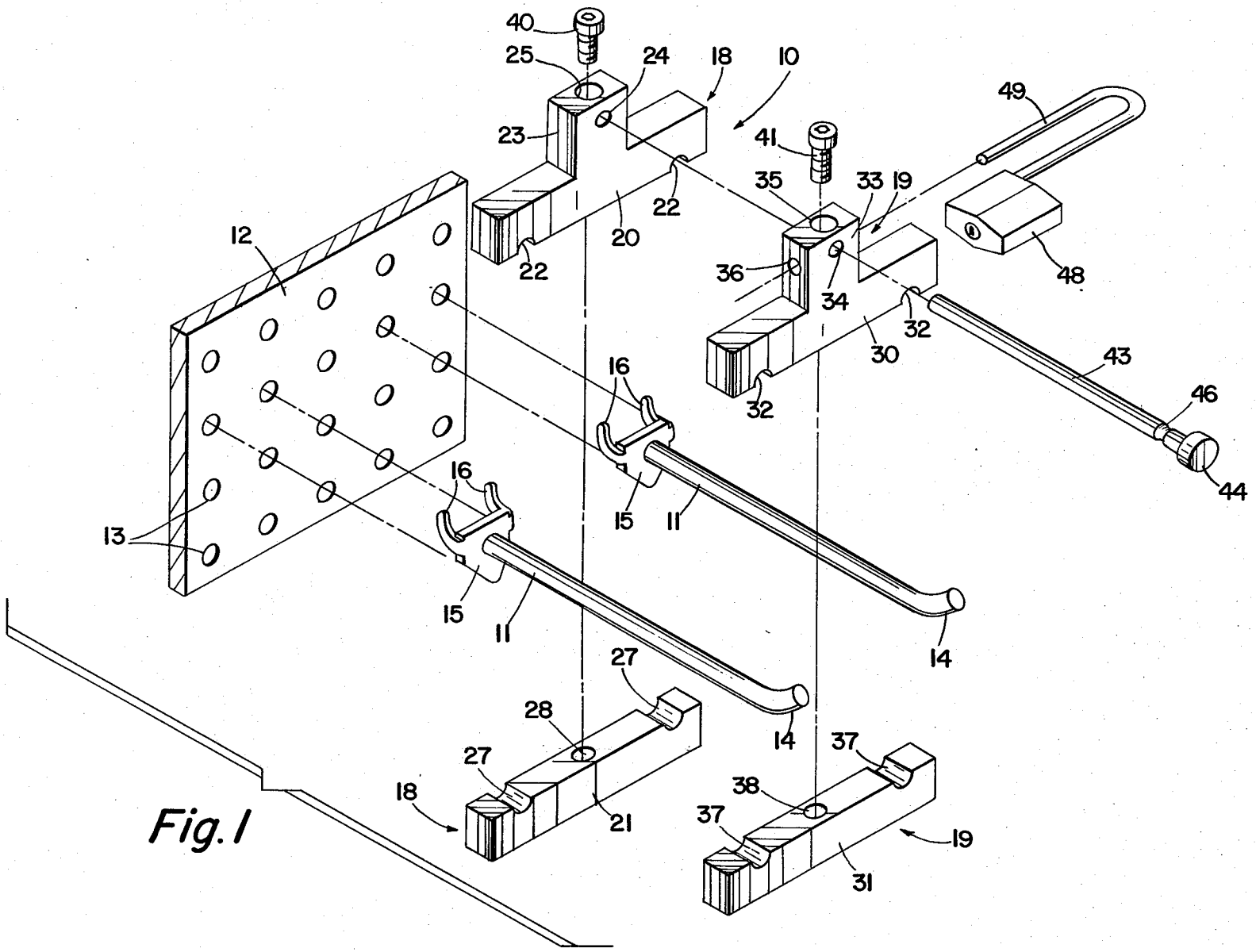
FIG. 1 is an exploded, perspective view of the device of the present invention and its association with a pair of hanger rods to be attached to a perforated board.
Figure 2:
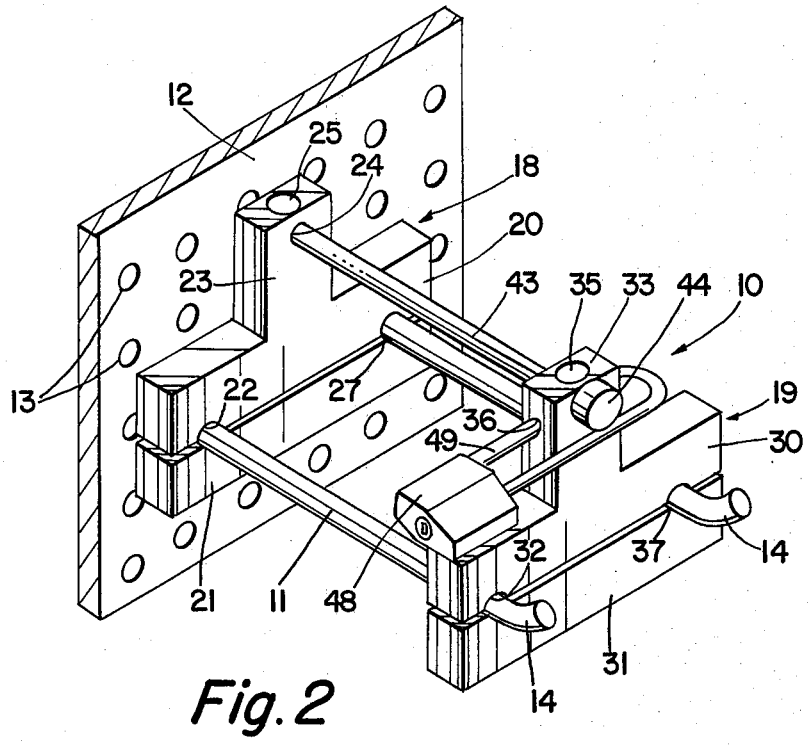
FIG. 2 is a perspective view of the device, hanger rods, and board of FIG. 1, as assembled.

Referring initially to FIGS. 1 and 2, there are shown the display security device 10 of the present invention in association with a hanger assembly comprising a pair of conventional, identical hangers or rods 11 and a conventional display board 12, commonly known as a "peg-board," having a plurality of identically spaced openings or perforations 13. FIG. 1 shows the device prior to its assembly on the rods 11, and FIG. 2 shows the device as assembled. The rods 11 each have an upwardly directed portion 14 at its outwardly extending end and a base 15 on the opposite end. The hanger base 15 contains one or more hooks 16 adapted to be inserted through the openings 13 to permit the rod 11 to be mounted on the board 12. When the rod 11 is mounted on the board, the base 15 fits against the surface of the board 12, and supports the rod thereby. When a pair of rods 11 are mounted on the board 12 in a horizontally spaced relationship, they form a conventional hanger assembly for displaying for sale various types of medium-sized merchandise. For example, tennis rackets may be displayed on such hangers by mounting the tennis racket frame over the rods so that the racket is supported by the frame.

The display security device 10 of the present invention comprises two split bar units 18 and 19. The inner split bar unit 18 is mounted on the rods 11 adjacent to the hanger base 15 and to the board 12. The outer split bar unit 19 is mounted on the rods 11 near its outwardly extending end adjacent to the end portion 14.

The inner split bar unit 18 comprises an upper bar portion 20 and a lower bar portion 21. The upper bar portion 20 comprises an elongated bar formed of heavy steel or similar material, having sufficient length to extend across a pair of horizontally spaced rods 11 and having a pair of notches 22 along its bottom surface so that the upper bar portion may be mounted on top of the rods 11. The upper bar portion 20 also has an upwardly extending cap portion 23 which is integrally formed with the horizontally extending bar portion. The upwardly extending cap portion 23 has a horizontally extending passage 24 which extends therethrough. In addition, the upper bar portion 20 has a vertically extending, countersunk opening 25 which extends downwardly from the top of the cap portion 23 and which is adapted for insertion of a screw, as hereinafter described. The lower bar portion 21 comprises an elongated bar of heavy steel or similar material which is approximately the same length as the upper bar portion 20, and which has a pair of corresponding notches 27 along its upper surface so that the lower bar portion 21 may be mounted beneath the pair of horizontally spaced rods 11. The lower bar portion 21 also has a vertically extending, threaded opening 28 which is aligned with the opening 25 in the upper bar portion 20.

The outer split bar unit 19 is essentially the same as the inner split bar unit 18 and comprises an upper bar portion 30 and a lower bar portion 31, both of heavy steel or similar material. The upper bar portion 30 is like the upper bar portion 20, with a horizontally extending bar portion having notches 32 along its bottom, and an upwardly extending cap portion 33 having a horizontally extending passage 34 and a vertically extending, countersunk opening 35. In addition, the cap portion 33 has an additional horizontally extending hole 36 which extends transversely to and is spaced slightly below the opening 34. The lower bar portion 31 is identical to the lower bar portion 21, and comprises a bar of approximately the same length as the upper bar portion 30 with notches 37 along its upper surface and a vertically extending, threaded opening 38.

The split bar units 18 and 19 are adapted to be mounted on the rods 11 by fitting the upper bar portions 20 and 30 together with the lower bar portions 21 and 31, with the rods 11 extending through the apertures provided by the adjacent notches 22, 27, 32, and 37 in the bar portions. The split bar units 18 and 19 are then secured together by fasteners, such as screws 40 and 41, which are inserted downwardly into the countersunk openings 25 and 35 in the upper bar portions 20 and 30, and threaded into the aligned, threaded openings 28 and 38 in the lower bar portions 21 and 31.

To secure the complete split bar units 18 and 19 together and to prevent access to the screws 40 and 41, a removable rod 43 is inserted through the horizontally extending passages 24 and 34 in the cap portions 23 and 33. The rod 43 has a knob 44 at one end and is approximately the same length as the rods 11, so that when the knob is inserted through the passages 24 and 34, the knob 44 abuts the cap portion 33, while the other end of the rod 43 opposite the knob 44 extends through the passage 24 in the cap portion 23 and abuts the surface of the board 12.

Figure 3:
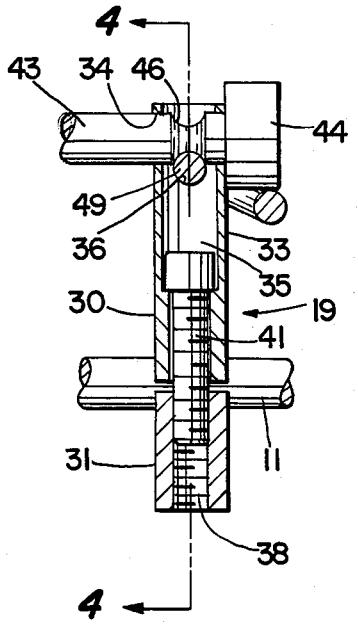
FIG. 3 is a side sectional view of the outer split bar unit of the device, showing the attachment of the lock means.
Figure 4:
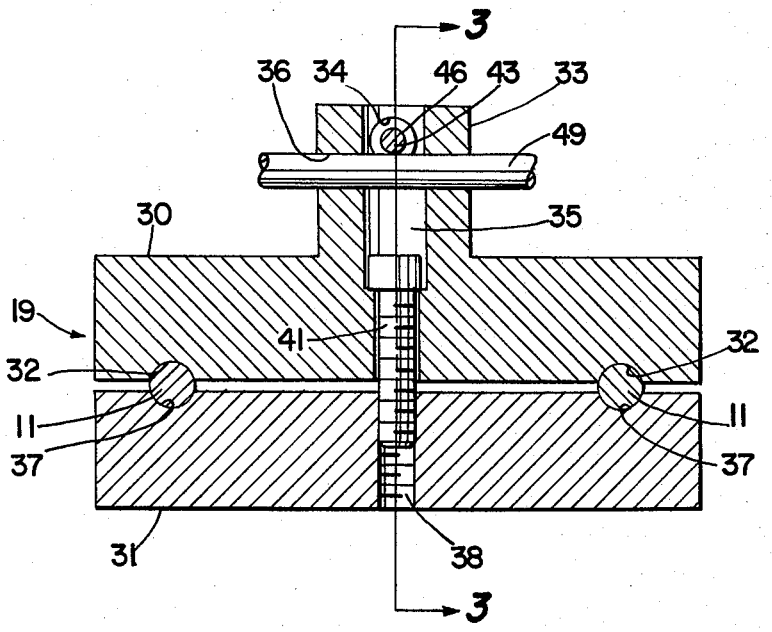
FIG. 4 is a front sectional view of the outer split bar unit, taken along line 4—4 of FIG. 3.

The rod 43 also has a circumferential groove 46 (FIG. 3) near one end adjacent to the knob 44. The groove 46 is located so that when the rod 43 is inserted through the upper bar portions 20 and 30, the groove 46 is aligned with the hole 36 in the cap portion 33. A padlock 48 is provided with an elongated shackle 49 which may be inserted through the hole 36 when the rod 43 is in place. The shackle 49 fits within the groove 46 and engages the rod 43 (FIG. 3), thereby preventing removal of the rod 43.

When the device 10 is assembled in place on the hanger assembly 11, as shown in FIG. 2, the rod 43 extends through both upper bar portions 20 and 30, and covers the vertically extending openings 25 and 35 to prevent access to the screws 40 and 41, so that the screws cannot be removed. By preventing removal of the screws 40 and 41, the split bar units 18 and 19 are locked in place on the rod 11, and removal of any items on the hangers is prevented. In addition, the position of the rod 43, with one end abutting the surface of the board 12, prevents removal of the rods 11 from the board by disengaging the hooks 16 on the rods 11 from the openings 13 in the board.

To remove items from the rods 11, responsible personnel are provided with the key or combination to the padlock 48. These personnel then unlock the padlock 48 and remove the shackle 49 from the hole 36 in the upper bar portion 30. With the shackle 49 removed, the rod 43 may be removed from the passages 24 and 34 in the upper bar portions 20 and 30 and items supported on the rods 11 may then be removed. After removal of the desired items of merchandise, the rod 43 is replaced and the device 10 is assembled as previously described.

With the rod 43 removed, the device 10 may be further disassembled by inserting a screwdriver or other tool downwardly into the vertically extending openings 25 and 35 to remove the screws 40 and 41 from the threaded openings 28 and 38 in the lower bar portions 21 and 31. The split bar units 18 and 19 may then be separated and removed from the rods 11. The device is reassembled as previously described.

Figure 5:
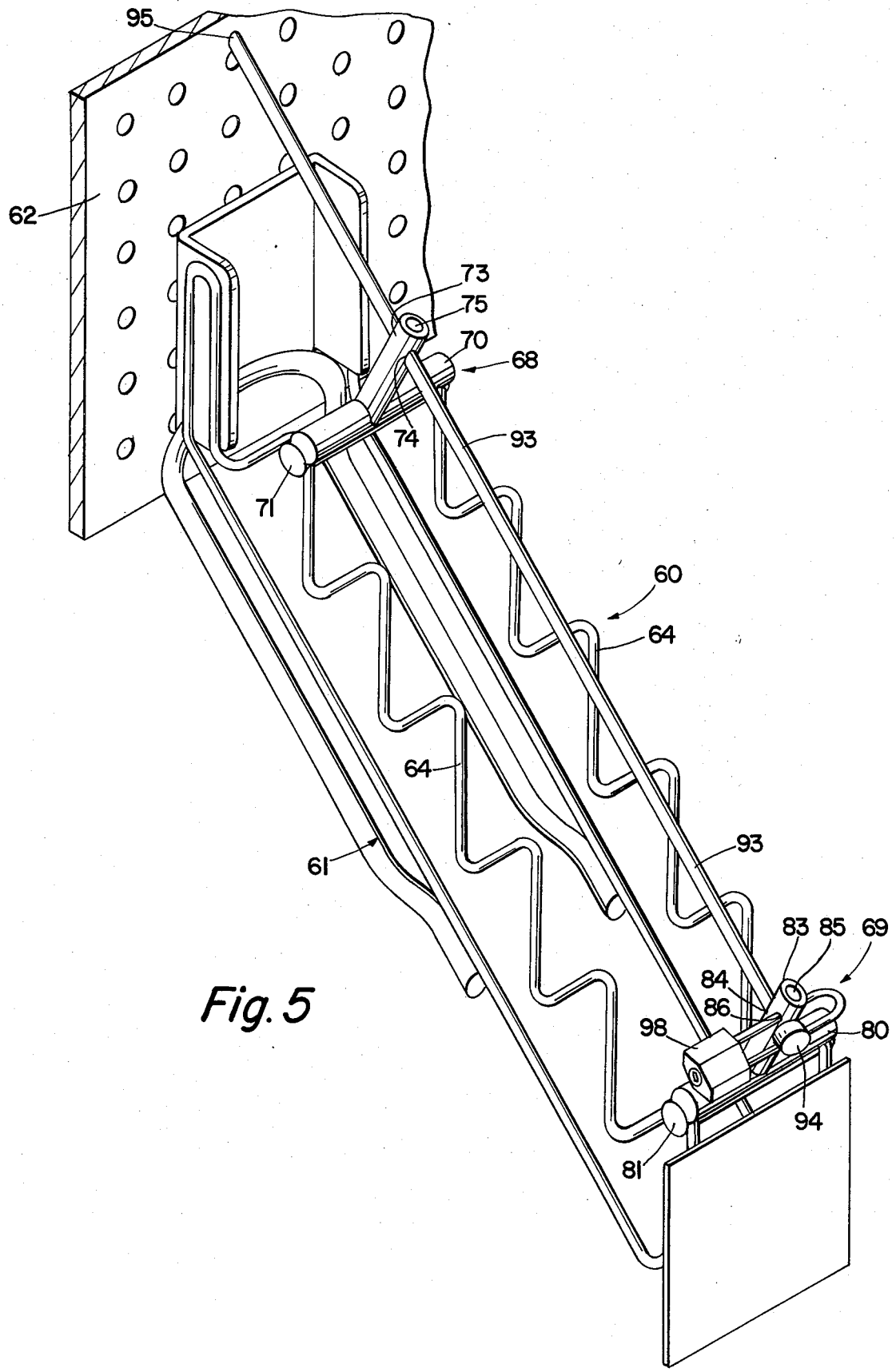
FIG. 5 is a perspective view of an alternative version of the device of the present invention mounted on a different hanger assembly attached to a perforated board.

The basic elements of the device of the present invention are adaptable for use on a variety of hangers which may be attached to perforated boards. FIG. 5 shows an alternative embodiment of the security device of the present invention. The device 60 is shown mounted on a unitary hanger assembly 61 attached to a perforated board 62. The hanger assembly 61 includes a pair of rods 64 having tiers or steps so that individual items of merchandise may be displayed thereon. The device 60 comprises an inner split bar unit 68 and an outer split bar unit 69.

The inner split bar unit 68 comprises an upper bar portion 70 and a lower bar portion 71. The upper bar portion 70 comprises a generally cylindrical bar portion of hardened steel or similar material which extends generally horizontally, as shown in the drawing, and which has notches along its bottom surface for fitting over the rods 64 of the hanger assembly 61. The upper bar portion 70 also has an upwardly extending, hollow cap portion 73 which has a transversely extending passage 74 therethrough and a central countersunk opening 75 for the insertion of a screw. The lower bar portion 71 also has corresponding notches along its upper surface for the hanger assembly 61 and has a threaded opening corresponding to and aligned with the opening 75 in the upper bar portion 70, so that a screw may be used to attach the bar portions 70 and 71.

The outer split bar unit 69 comprises an upper bar portion 80 and a lower bar portion 81. The upper bar portion 80 is like the upper bar portion 70, with a generally horizontally extending, cylindrical bar portion having notches along its bottom surface and having an upwardly extending, hollow cap portion 83 having a transverse passage 84 and a central countersunk opening 85. The upper bar portion 80 also has a hole 86 extending perpendicular to both the passage 84 and the opening 85 and located slightly below the passage 84. The lower bar portion 81 is identical to the lower bar portion 71, and comprises notches along its upper surface for the hanger assembly 61 and an opening corresponding to and aligned with the opening 85 so that a screw may be inserted through the openings to attach the upper bar portion 80 to the lower bar portion 81.

A rod 93 is inserted through the passages 74 and 84 in the cap portions 73 and 83. The rod 93 has a knob 94 at one end and is of sufficient length so that when the rod is inserted through the passages in the upper bar portions 70 and 80, with the knob 94 abutting the upper bar portion 80, the end 95 of the rod opposite the knob 94 abuts the board 62 to prevent the hanger assembly 61 from being lifted and removed from the board. As with the previously described rod 43, the rod 93 has a groove near the end adjacent to the knob 94 so that the shackle of a padlock 98 may be inserted through the hole 86 and may engage the groove in the rod 93 to prevent removal of the rod from the upper bar portion 80.

When it is desired to remove articles of merchandise from the hanger assembly 61, the padlock 98 is unlocked and the shackle is removed from the hole 86, disengaging the shackle from the groove in the rod 93, so that the rod 93 may be removed from the upper bar portions 70 and 80 of the split bar unit 68 and 69. The articles of merchandise may then be removed from the hanger assembly.

With the rod 93 removed, the device may be further disassembled by inserting a tool downwardly into the openings 75 and 85 to remove the screws which attach the upper bar portions 70 and 80 to the lower bar portions 71 and 81. The split bar units 68 and 69 are then separated. Thereafter, the device 60 may be reassembled in place.

While the invention has been shown and described with respect to specific embodiments thereof, these are intended for the purpose of illustration rather than limitation, and other modifications and variations will be apparent to those skilled in the art, all within the intended spirit and scope of the invention.

What is claimed is:

1. A security device for use with a hanger extending from a board, the device comprising:

two split bar units mounted on the hanger, one bar unit mounted near the end of the hanger adjacent to the board, the other bar unit mounted on the hanger near the opposite end thereof, each split bar unit comprising two bar portions secured together by releasable fastening means, each bar unit having a passage extending therethrough;

a removable rod inserted through the passage in each bar unit and extending between the bar units, the rod preventing release of the fastening means; and lock means for preventing removal of the rod from the passages in the bar units.

2. A security device as in claim 1, wherein the rod is capable of extending to the board to prevent disengagement of the hanger with the board.

3. A security device as in claim 1, wherein the rod has a circumferential groove which is engaged by the lock means to prevent removal of the rod.

4. A security device as in claim 1, wherein the lock means is attached to said other bar unit to secure the rod to said other bar unit.

5. A security device as in claim 1, wherein the passage in each of the bar units intersects the axis of the fastening means, and the rod extending through the passage prevents access to the fastening means.

6. A security device as in claim 1, wherein the lock means comprises a padlock having a shackle which engages the rod to prevent removal of the rod.

7. A security device as in claim 6, wherein said other bar unit has a hole through which the shackle is inserted to prevent removal of the rod.

8. A security device as in claim 7, wherein the rod has a circumferential groove which is engaged by the shackle.

9. A security device as in claim 1, wherein each of the bar portions has a notch adapted to be fit with the hanger.

10. A security device for preventing unauthorized removal of items from a pair of hanger rods hooked to a perforated board, which comprises:

two split bar units mounted on the hanger rods, one bar unit mounted near the end of the hanger rods adjacent to the board, the other bar unit mounted on the hanger rods near the opposite ends thereof, each split bar unit comprising an upper bar portion and a lower bar portion secured together by releasable fasteners, each upper bar portion having a passage extending therethrough, said other bar unit also having a hole extending therethrough and intersecting the passage;

a removable securing rod inserted through the passage in each upper bar portion and extending between the bar units, the securing rod being capable of extending to the board to prevent disengagement of the hanger rods from the board, the securing rod covering the fasteners to prevent release of the fasteners; and a padlock having a shackle inserted through the hole in said other bar unit and engaging the circumferential groove in the securing rod to attach the securing rod to said other bar unit and prevent removal of the securing rod.

11. A security device as in claim 10, wherein each of the bar portions has a pair of grooves for engagement by the hanger rods.

* * * * *